US005425150A

United States Patent [19]

Palmer, Jr. et al.

[11] Patent Number: 5,425,150

[45] Date of Patent: Jun. 20, 1995

[54] ARTICULATING DEVICE FOR A FLAT BED

[76] Inventors: John M. Palmer, Jr., P.O. Box 115, Lutz, Fla. 33549; John M. Palmer, III, P.O. Box 823291, Dallas, Tex. 75382

[21] Appl. No.: 78,408

[22] Filed: Jun. 17, 1993

[51] Int. Cl.[6] ..... A61G 7/00

[52] U.S. Cl. ..... 5/615; 5/620; 5/634

[58] Field of Search ..... 5/614, 615, 620, 634

[56] References Cited

U.S. PATENT DOCUMENTS

| | | | |
|---|---|---|---|
| 2,666,216 | 1/1954 | Schnaitter | 5/634 X |
| 3,606,623 | 1/1970 | Amar . | |
| 3,781,928 | 1/1974 | Swallert | 5/615 X |
| 4,104,749 | 8/1978 | Grundler . | |
| 4,309,783 | 1/1982 | Cammack et al. . | |
| 4,527,298 | 7/1985 | Moulton | 5/615 |
| 4,625,348 | 12/1986 | Renggli et al. | 5/614 |
| 4,651,365 | 3/1987 | Zeigler | 5/616 X |
| 4,873,731 | 10/1989 | Williamson . | |
| 5,311,625 | 5/1994 | Barker et al. | 5/615 |

*Primary Examiner*—Michael F. Trettel

[57] ABSTRACT

A device for converting a flat bed into an adjustable bed. The system (10) has a base (20) which mounts on the bed's box-springs (14) and an articulating platform (30) sandwiched between the box-springs (14) and the mattress head section (18A). The articulating platform (30) pivots about the pivoting end (28) of base (20) by inflating bellows (40). The controls (42, 43, 44) provide for adjustable firmness, degree and speed of pivoting, and delay for the start of the deflating of bellows (40) for lowering articulating platform (30).

3 Claims, 2 Drawing Sheets

ARTICULATING DEVICE FOR A FLAT BED

BACKGROUND-FIELD OF INVENTION

This invention relates to beds, specifically to beds in which the mattress head and or leg sections can be raised or lowered.

BACKGROUND-DESCRIPTION OF PRIOR ART

The benefits of adjustable beds are appreciated by many individuals. Most homes already have a substantial investment in beds. It is undesirable having to dispose of an existing bed when purchasing an adjustable bed. And, to furnish the entire household with adjustable beds may be economically impossible for some families.

Patents of the prior art, and the present invention, have attempted to make adjustable beds available to everyone by converting existing flat beds into adjustable beds. Unfortunately, the prior art patents have lacked certain features necessary for successful use and marketing.

In Aymar, U.S. Pat. No. 3,606,623 and Cammack et al, U.S. Pat. No. 4,309,783 the inner-springs serves as the base for the system, an inflatable bellows pushes from this base to lift the mattress. When a user lays on the side of the bed there will be a tendency for that side to sink while the other side rises. Cammack's use of an element within the inflatable bellows to define its shape is costly and a source for potential failure and air leaks.

Grundler, U.S. Pat. No. 4,104,749 illustrates a mechanical lifting device located under the bed inner-springs. A considerable amount of labor would be required to install this system.

In another system, Williamson, U.S. Pat. No. 4,873,731 hinges the mattress support frame from the bed frame. A user will rub against the hinge bracket while getting in and out of bed. Mass marketing would be difficult because of the large number of hinge brackets necessary to fit the many different beds in use. The need for a dual blower is debatable.

OBJECTS AND ADVANTAGES

Accordingly, objects and advantages of the present invention are:

(a) to provide a base that can be laid on the inner-springs without attachment to the inner-springs or the bed frame, thus simplifying the installation process for those not mechanically inclined;

(b) to provide a base that underlies the articulating platform thereby increasing the stability of the system;

(c) to provide a device with parts that more or less nest within themselves providing for the minimum dimensions for shipping;

(d) to provide a device that can be lowered without crushing hands or fingers under the side edges of the bed;

(e) to provide a device that has the controls built in the side of the articulating platform in easy reach of a user;

(f) to provide a device that will descend to a horizontal position at an adjustable rate after the user falls asleep;

(g) to provide a device that will provide both a firm and a spongy feel.

Further objects and advantages are to provide an articulating device that can be economically manufactured and distributed. Still further objects and advantages will become apparent from a consideration of the ensuing description and drawings.

DRAWING FIGURES

In the drawings, closely related figures have the same number but different alphabetic suffixes.

REFERENCE NUMERALS IN DRAWINGS

1–5 FIGS.
10 preferred embodiment
12–18B bed frame, inner-springs, pad, mattress
20–29 base
30–39 articulating platform
40–48 pneumatic system

DESCRIPTION OF THE INVENTION

Figure 1:
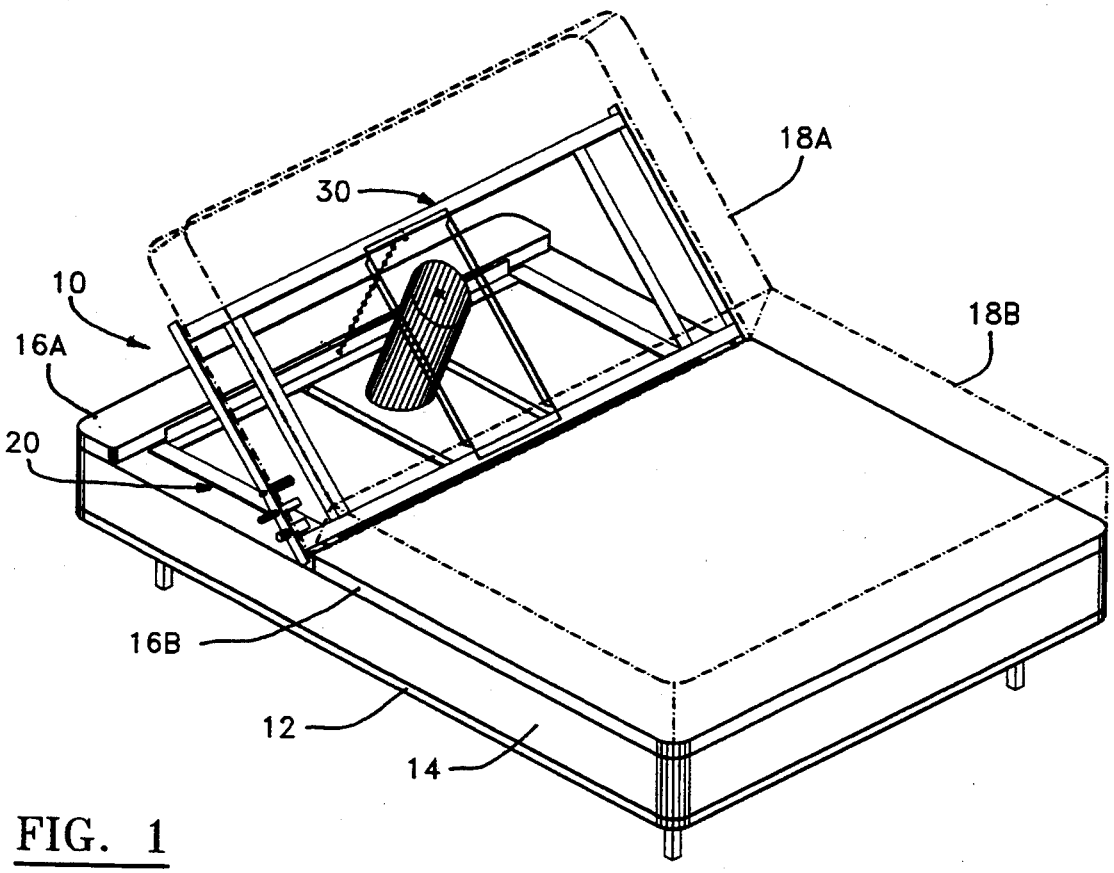
FIG. 1 is a 3-D view of a flat bed with the head section raised incorporating the device of this invention.

A preferred embodiment 10 of the present invention is illustrated in FIG. 1 (3-D view). The flat bed frame 12 is shown with inner-springs 14, leveling pad 16A and 16B, mattress head section 18A and mattress 18B. Base 20 mounts on inner-springs 14. Articulating platform 30 is pivotally connected to base 20. For clarity optional pan 37 which underlies mattress head section 18A (FIGS. 4 and 5) is not shown.

Figure 2:
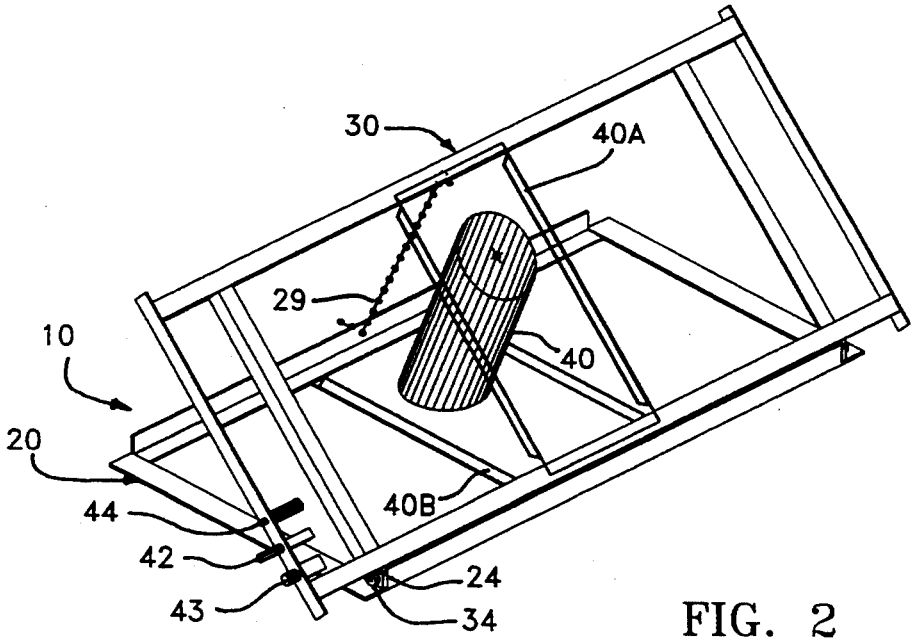
FIG. 2 is a 3-D view of the articulating device of FIG. 1 without the existing bed parts shown.

FIG. 2 illustrates articulating device base 20 and platform 30 ready for mounting on a bed. Base hinge 24 and articulating platform hinge 34 are shown on the pivoting ends of the base 20 and articulating platform 30. Articulating platform 30 is shown in an elevated position with bellows 40, bellows top structure 40A in a transparent view, and bellows base structure 40B, providing the pivoting means and a knotted rope like restraint means 29. By adjusting the air pressure in bellows 40 with pressure regulator 43 to an amount sufficient to just lift the mattress head section 18A it will have a spongy feel or minimum support. If the air pressure is increased articulating platform 30 will continue to pivot to the limits of bellows 40. This will produce a firmer feel. However, if a firm intermediate position of articulating platform 30 is desired it can be restrained by adjustable restraint 29. Additionally, if a user wishes to watch TV but knows he or she will fall to sleep before lowering articulating platform 30 a combination of features will solve the problem as follows:

1. Set restraint 29 for the angular position of mattress head section 18A desired.
2. Increase supply air pressure with regulator 43 to create a reserve of compressed air in bellows 40.
3. Open speed control 44 (a flow control valve) just enough so that the reserve air in bellows 40 will have escaped and will start lowering mattress head section 18A soon after the user falls to sleep.
4. Actuate control valve 42 to the down position to start the process.

Figure 3:
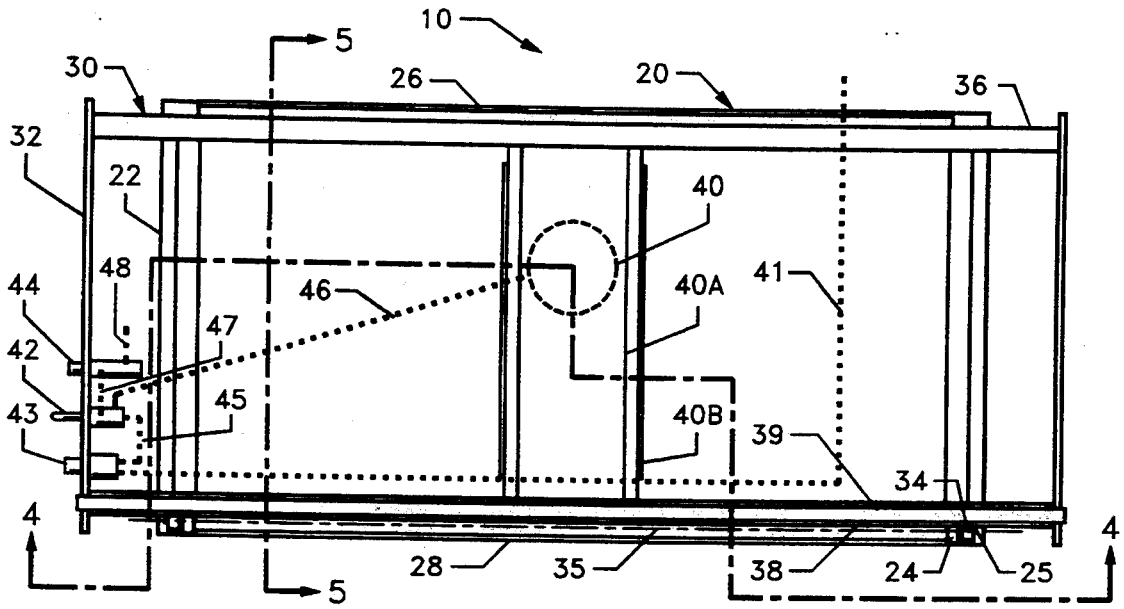
FIG. 3 is a plan view of the articulating device of FIGS. 1 and 2 in a lowered position.

FIG. 3 in plan view illustrates that base 20 is narrower than articulating platform 30. The side 32 of articulating platform 30 overlaps side 22 of base 20. This prevents accidentally crushing one's hands or fingers between the two when platform 30 is lowered. An alternate design would be to recess the sides of both base 20 and articulating platform 30 from the sides of inner-springs 14 and mattress head section 18A. 26 represents the free end of base 20 and 36 the free end of articulating platform 30. 28 represents the pivoting end of base 20 and 38 the pivoting end of articulating platform 30. Hinge part 24 is attached to base 20, hinge part 34 is attached to articulating platform 30. Pivoting axle 25 connects the two hinge parts defining pivoting axis 35. Wide beds may require two inflatable bellows 40 to raise platform 30 while narrow beds only one. Fold defining strap 39, which forces the fold location on stiff mattresses, connects to the side edges 32 of platform 30 near the pivoting end 38. Control valve 42, pressure regulator 43, and speed control valve 44 are mounted on one or both sides of articulating platform 30 in easy reach of a user. Air line 41 supplies air regulator 43 with compressed air. Air line 45 supplies control valve 42 with regulated compressed air. Air line 46 supplies compressed air to bellows 40. Air line 47 routes exhaust air from control valve 42 to flow or speed control valve 44 for adjusting the speed bellows 40 will deflate. Air line 48 is used to connect an optional muffler. Details at cut lines 4—4 and 5—5 are shown in FIGS. 4 and 5 respectfully.

Figure 4:
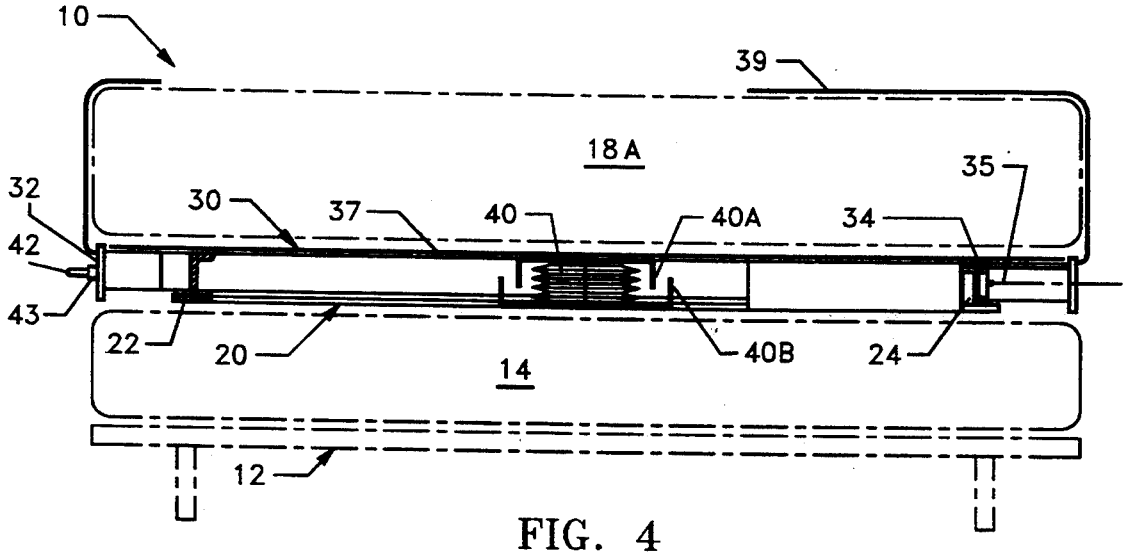
FIG. 4 is a fragmented transverse sectional elevation view of the device of FIG. 3.

FIG. 4 illustrates the device in a down position mounted on inner-springs 14 and underlying mattress head section 18A with fold defining strap 39 in place. Bellows 40 is shown in a deflated position. Optional pan 37 is installed on platform 30.

Figure 5:
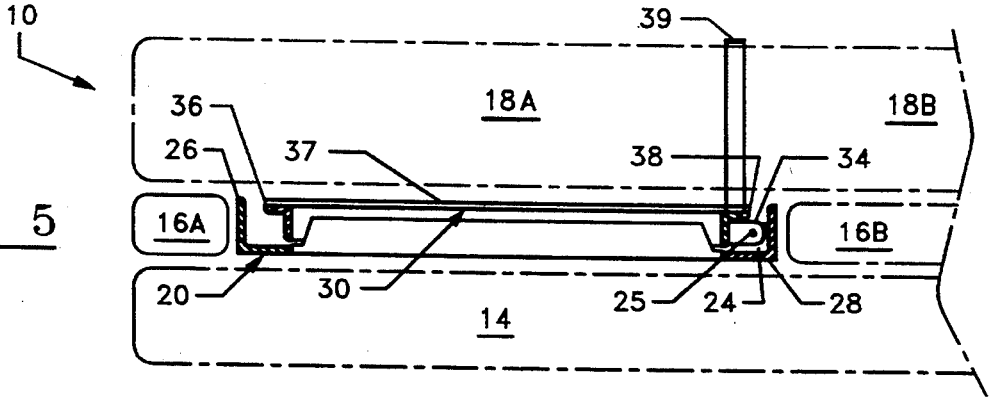
FIG. 5 is longitudinal sectional elevation view of the device of FIG. 3.

FIG. 5 illustrates base 20, free end 26, and pivoting end 28. Articulating platform 30 with free end 36 and pivoting end 38 is shown in the lowered position compactly nested in platform base 20. Leveling pads 16A and 16B fill in those areas over the inner-springs that are not covered by the articulating device. This provides a level surface for mattress head section 18A and mattress 18B to rest on.

While not illustrated for raising the leg section of a mattress an identical device as described above or a similar one can be used for that purpose.

SUMMARY OF THE INVENTION

Accordingly, the reader will see that the present invention describes a system for converting a flat bed into an articulating or adjustable bed. The system can be installed with a minimum of effort, and without modifying the bed frame. Fingers will not be crushed if the device is lowered on them. Shipping cost will be minimal due to the compact design. Furthermore, the device has the additional advantages in that

- it provides for rasing and lowering the head of the mattress at a varying speed;
- it provides for a firmness range from spongy to firm;
- it provides for a delayed down position after the user falls asleep;
- it provides for a pneumatic drive system thus eliminating the need for electrical devices within the bed;
- it provides a way to fold a stiff mattress at a desired location;
- it provides a way for the owner of an existing bed to have an adjustable bed at a minimum cost.

Preferred embodiments and variants have been suggested for this invention. Other modifications may be made, as by adding, combining, deleting, or subdividing components, parts, or steps, while retaining advantages and benefits of the present invention.

We claim:

1. A device for raising and lowering to various angular positions the head or leg sections of a mattress of a flat bed comprising:

a base for mounting on top of a bed's inner-springs, or on top of said bed's frame if there is no inner-springs, said base having a free end and a pivoting end;

an articulating platform underlying said mattress, said articulating platform having a free end, a pivoting end, and two side edges, said pivoting end of said articulating platform pivotally connected to said pivoting end of said base;

leveling means for elevating that area of said mattress not overlaying said device, said leveling means having a height approximately equal to the height of said device when said articulating platform is in a horizontal position;

means for pivoting said articulating platform between a horizontal and an inclined position.

2. Device as defined in claim 1, further including control means for actuating said pivoting means, said control means mounted in or on one or both side edges of said articulating platform.

3. A method of installing and using an articulating device for a flat bed, said method comprising:

providing a flat bed with inner-springs or a bed frame and a mattress;

providing an articulating device with pivoting and control means for a flat bed;

providing a leveling means;

removing said mattress from said flat bed and mounting said articulating device on said inner-springs, or on top of said bed's frame if there is no inner-springs, placing said leveling means on the area of said inner-springs or frame not occupied by said articulating device, placing said mattress on top of said articulating device and said leveling means, and by actuating said control means the head or leg section of said mattress is pivoted to a desired angular position.

* * * * *